United States Patent [19]

Naef

[11] 4,181,383

[45] Jan. 1, 1980

[54] DIFFERENTIAL ROLL PULL-OUT SYSTEM

[75] Inventor: Emil Naef, Goldach, Switzerland

[73] Assignee: Walter Baumann, Herisau, Switzerland

[21] Appl. No.: 885,041

[22] Filed: Mar. 9, 1978

[30] Foreign Application Priority Data

Mar. 11, 1977 [CH] Switzerland ..... 3105/77

[51] Int. Cl.[2] ..... A47B 88/00

[52] U.S. Cl. ..... 312/334; 312/339; 312/342; 312/348

[58] Field of Search ..... 312/330 R, 333, 338, 312/339, 342, 348, 341, 341 NR, 350, 346, 334; 308/3.6

[56] References Cited

U.S. PATENT DOCUMENTS

| | | | |
|---|---|---|---|
| 1,518,687 | 12/1924 | Bullock | 312/333 |
| 2,675,277 | 4/1954 | McClellan | 312/339 |
| 2,864,656 | 12/1958 | Yorinks | 312/339 |
| 3,181,925 | 5/1965 | Fischer | 312/339 |
| 3,371,968 | 3/1968 | Loake | 312/333 |
| 3,386,784 | 6/1968 | Oppenhuiben et al. | 312/348 |
| 3,462,203 | 8/1969 | Del Vecchio | 312/348 |
| 3,488,097 | 1/1970 | Fall | 312/339 |
| 3,679,275 | 7/1972 | Fall et al. | 312/341 NR |
| 3,701,577 | 10/1972 | Fischer | 308/3.6 |
| 4,004,841 | 1/1977 | Vander Ley | 312/342 |

FOREIGN PATENT DOCUMENTS

| | | | |
|---|---|---|---|
| 72285 | 2/1976 | Australia | 312/341 |
| 95660 | 1/1960 | Norway | 312/339 |

*Primary Examiner*—Victor N. Sakran
*Attorney, Agent, or Firm*—Karl W. Flocks

[57] ABSTRACT

A differential roll pull-out system for drawers or the like comprising stationarily mounted guide rails, pull-out or retraction rails guided thereat and traveling rails guided at the pull-out rails and coacting in pairs with the drawer or the like. The rails are mutually guided at one another by means of roller bodies. Each pull-out rail is constructed as a hollow structural or profile member having at least one hollow compartment within which there are received roller bodies. Each of the roller bodies is fixed, without the aid of bolts and screws, by means of two respective collets or collars arranged opposite one another at the related pull-out rail.

6 Claims, 13 Drawing Figures

DIFFERENTIAL ROLL PULL-OUT SYSTEM

BACKGROUND OF THE INVENTION

The present invention relates to a new and improved construction of differential roll or roller pull-out system for drawers or the like, which is of the type comprising stationarily mounted guide rails, pull-out or retraction rails guided thereat and traveling rails guided at the pull-out rails, the traveling rails coacting in pairs with the drawer or the like, and the rails are mutually guided at one another by means of roller bodies.

Heretofore known roller pull-out systems are not totally satisfactory as regards the traveling or mobility characteristics and stability in the lateral direction, especially when working with heavy loads, and additionally require a complicated support and mounting of the roller bodies. In order to increase the stability there are frequently employed traverses or crosstie members which transversely interconnect both of the pull-out rails. Such construction is complicated.

SUMMARY OF THE INVENTION

Hence, it is a primary object of the present invention to provide a new and improved construction of differential roll pull-out system of the previously mentioned type which is simpler in construction and affords improved stability and traveling or mobility characteristics.

Still another and more specific object of the present invention aims at a new and improved construction of a roll pull-out system for an element, such as typically a drawer, shelf or the like, which is relatively simple in construction and design, economical to manufacture, extremely reliable in operation, not readily subject to malfunction or breakdown and requires a minimum of maintenance and servicing.

Yet a further significant object of the present invention aims at the provision of an improved arrangement for pulling-out a drawer or the like by means of rollers and coacting rails, wherein such arrangement is extremely reliable in operation, provides for positive pull-out of the drawer and reinsertion thereof into its housing, such as a desk or cabinet, with a minimum of effort, while affording increased stability, running properties and load-carrying capability.

Now in order to implement these and still further objects of the invention, which will become more readily apparent as the description proceeds, the differential roll pull-out system of the present development is manifested by the features that each pull-out rail is constructed as a hollow section or profile member having at least one hollow compartment in which there are housed the roll or roller bodies, and that the roller bodies are fixed without bolts and screws or the like by means of two respective collets or collars arranged opposite one another at the pull-out rails.

Firstly, by virtue of the foregoing construction there is dispensed with, on the one hand, the heretofore conventionally required complicated mounting of the roll or roller bodies, such as ball bearings and/or rolls, by means of screws, bolts or the like. On the other hand, due to the closed construction of the pull-out or retraction rails there is obtained increased stability, and the oppositely situated side walls of the pull-out rails furthermore enable forming thereat, such as by embossing, oppositely situated collars or collets at both sides of the roll or roller bodies.

With the roll traction or pull-out system of the invention the pull-out rails possess such stability against bending and torsion that there are afforded extremely good traveling or running properties also when working with heavy loads without the need to interconnect the rails pairs by means of traverses or equivalent structure. This results in a saving in work and material. At the same time there is realized an extremely simple mounting and lateral support of the roll bodies by the collars formed at the pull-out rails.

A further improvement of the inventive roll pull-out system can be obtained in that the pull-out rails are guidingly supported with extremely low friction against lateral forces at the guide rails and similarly the traveling rails are guidingly supported with extremely low friction against lateral forces at the pull-out rails. A preferred exemplary embodiment of the invention is manifested by the features that the roll bodies coact with inclined regions of the related rails. Therefore, there is provided at each rail a lateral guide having play essentially working with rolling friction between the drawer and the pull-out rails.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
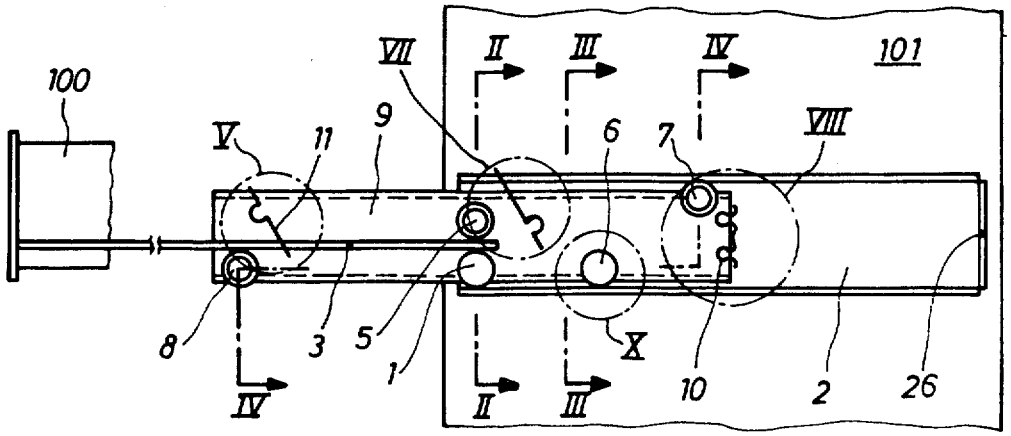
FIG. 1 is a schematic side view of a differential roll or roller pull-out system or arrangement constructed according to the teachings of the present invention, showing the related drawer or the like in its retracted or pulled-out condition.

Describing now the drawings, in FIG. 1 there is illustrated an exemplary embodiment of differential roll or roller pull-out system for a drawer 100 or equivalent structure, which will be seen to comprise a pair of traveling or mobile rails 3 connected with the drawer 100. In the context of this disclosure the term "drawer" is used in its broadest sense to encompass any type of suitable element, such as a drawer or shelf, by way of example, which can be pulled-out or reinserted, typically for instance into a cabinet, desk or other housing. Continuing, the traveling rails 3 are guided at a pair of pull-out or retraction rails 9 by means of ball bearings 5 which roll upon the top or upper surface 4 of the traveling rails 3 and the ball bearings 8 and rolls or rollers 1 which roll upon the bottom surface or underside 4*a* of the traveling rails 3. The pull-out rails 9, in turn, are guided by means of ball bearings 7 and the rolls 1 and 6 at a pair of guide rails 2 which are fixedly mounted in a cabinet housing 101 or equivalent structure.

During retraction or pull-out of the drawer 100 the visible roll 1 rolls upon the associated guide rail 2 and the traveling rail 3, the top or upper surface 4 of which places into rotation the race of the ball bearing 5. The ball bearing 7 and the roll 6 upon the guide rail 2, and the roll 6, in the inserted condition of the drawer 100, also serves for supporting the related traveling rail 3. The roll 1 and the ball bearing 8 roll upon the underside or bottom surface 4*a* of the associated traveling rail 3. The traveling rails 3 are also predominantly guided by means of the roller bodies 1 and 8 and the pull-out rails 9 are predominantly guided by means of the roller bodies 1 and 7.

Based upon the foregoing description of the differential pull-out system it will be apparent that the pull-out rails 9 always move through approximately one-half of the displacement path of the traveling rails 3.

Figure 8:
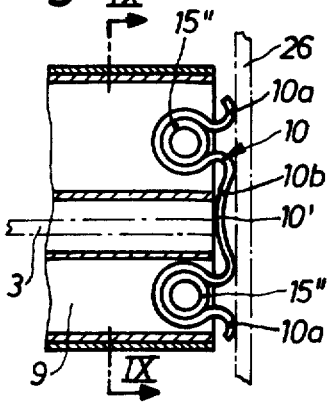
FIG. 8 is a detail of the arrangement of FIG. 1, taken substantially at the location VIII thereof.
Figure 9:
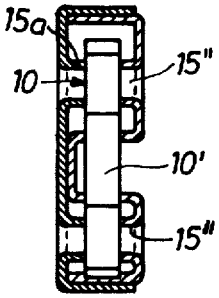
FIG. 9 is a sectional view of the arrangement of FIG. 8, taken substantially along the line IX—IX thereof.

Now at the inner right-hand end of the depicted pull-out rail 9 shown in FIG. 1 there are mounted first stop means, in the form of stop or impact springs 10, which for stroke or displacement limiting purposes, during insertion of the drawer 100, coact with a web or impact member 26 secured at the inner or inbound end of the guide rails 2, and thus limit and dampen the insertion stroke. In the showing of FIGS. 8 and 9 each of the first impact or stop springs is in the form of a blade spring or the like which is wound about two collar or collet pairs 15*a* formed, for instance, by embossments in the parts or components 19 and 20 of the related pull-out rail 9, with each collar pair comprising the aligned collars or collets 15". Each such blade spring 10 cooperates at its outer portions 10*a* with the web or impact member 26 or the like and its inner portion 10*b*, i.e., its intermediate region 10' which is located between both of the collar pairs 15*a*, can resiliently dampen or retard the push-in motion of the traveling rails 3, as best seen by referring to FIG. 8.

According to the showing of FIGS. 1 and 5 to 7 two second stop or impact members in the form of stop or impact springs 11 and 12 are pivotably mounted upon collar or collet pairs 15*b* having the aligned collars or collets 15' and formed at the parts 19 and 20 of the pull-out rails 9. The impact or stop spring 11 protrudes with one end 11 ' into a longitudinal slot 13 of the related traveling or mobile rail 3, and such spring end 11' is turned in the lengthwise direction of the slot 13 such that this slot 13 can be of narrow configuration. The other nonturned end 11" of the impact or stop spring 11 protrudes into a slot 9' of the related pull-out rail 9.

In corresponding manner an upper, turned end 12 ' of the stop or impact spring 12 protrudes into a lengthwise or longitudinal slot 14 of the related guide rail 2, whereas the lower, nonturned end 12 " of such spring 12 protrudes into a slot 9" of the related pull-out rail 9.

Now with the drawer 100 in its pulled-out position the stop of impact springs 11 and 12 engage into the slots 13 and 14 respectively. During insertion of the drawer 100 the impact springs 11 and 12 rock about the related collars 15' and thus slide by means of their outermost edge 16 and 16' of the respective twisted end 11' and 12' along the upper or top surface 4 of the related traveling rail 3 and the inner surface 17 of the related guide rail 2. Upon latching of the impact springs 11 and 12 in the slots 13 and 14, respectively, there is thus produced a stroke limiting action in the pull-out direction of the drawer 100.

Now in FIGS. 2 to 4 and 10 and 13 there are shown details and modifications of the guide arrangement of the pull-out system portrayed in FIG. 1.

Figure 2:
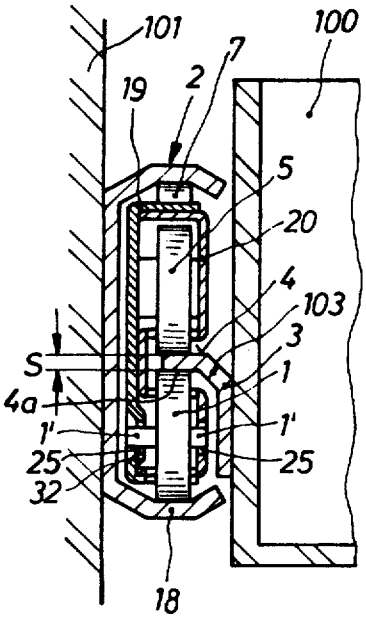
FIG. 2 is an enlarged fragmentary sectional view of the system of FIG. 1, taken substantially along the line II—II thereof.
Figure 3:
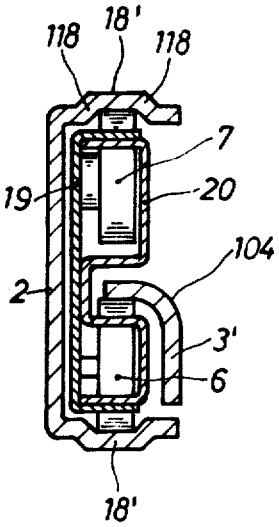
FIG. 3 is an enlarged fragmentary sectional view of a modified arrangement from that shown in FIG. 1, the section being taken substantially along the line III—III thereof.
Figure 4:
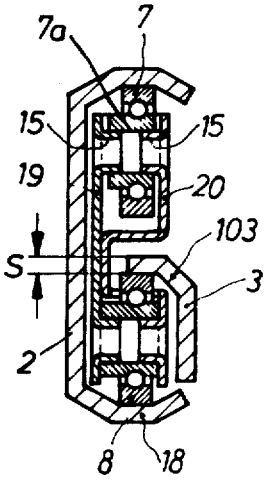
FIG. 4 is an enlarged fragmentary sectional view of the system of FIG. 1, taken substantially along the line IV—IV thereof.
Figure 5:
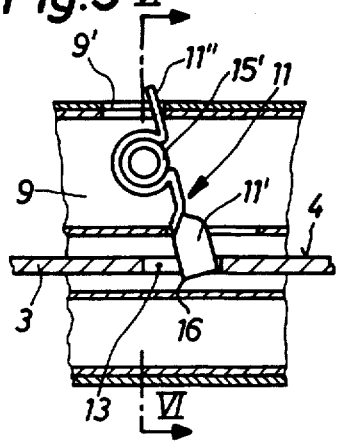
FIG. 5 is a detailed sectional view of the arrangement of FIG. 1, taken at the location V thereof.
Figure 6:
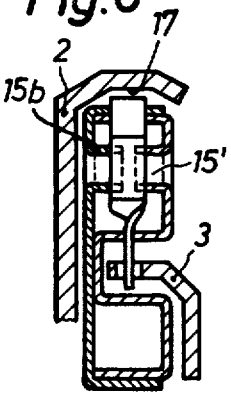
FIG. 6 is a sectional view of FIG. 5, taken substantially along the line VI—VI thereof.
Figure 7:
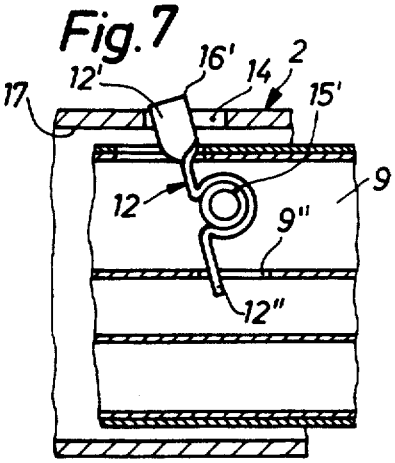
FIG. 7 is a detail of the arrangement of FIG. 1, taken substantially at the location VII thereof.
Figure 11:
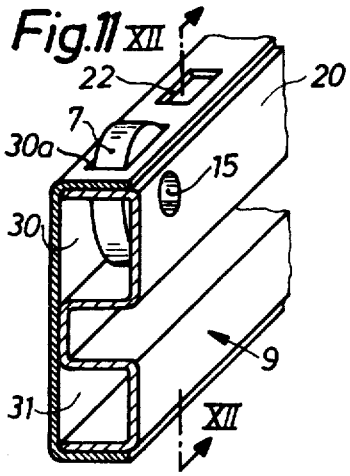
FIG. 11 is a fragmentary perspective view of a pull-out rail employed in the arrangement or system of FIGS. 1 to 10.
Figure 12:
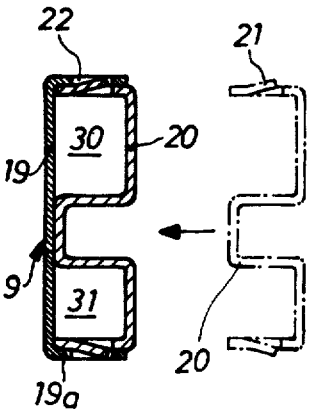
FIG. 12 is a sectional view, taken substantially along the line XII—XII of FIG. 11, there being shown part of the pull-out rail in phantom lines as a separate component prior to its assembly with the other part of such pull-out rail.

It will be seen that each stationary guide rail 2, as shown in FIGS. 2, 3 and 4, is provided in section with an approximately W-shaped leg 18, at the base of which there are laterally guided with rolling friction both of the ball bearings 7, 8 and the rolls 1, 6 respectively. These ball bearings and rolls are received in the hollow compartments 30 and 31 of the pull-out rails 9 (FIGS. 11 and 12), which are formed by joining together two structural or profile members or parts 19 and 20 into the related pull-out rail 9. The one substantially U-shaped profile part or member 19 receives the other substantially M-shaped part 20 between its U-shaped legs 19*a*, and retention of both parts 19 and 20 in interlocking fashion is advantageously achieved by the latching of upwardly flexed tabs or tongues 21 of the part 20 into corresponding openings 22 of the other part 19. There is additionally shown in FIG. 11 the ball bearing 7 which is received in the pull-out rail compartment 30 and its mounting at such pull-out rail 9. This ball bearing 7 extends at its upper region through an opening 30*a* out of the compartment 30 of such pull-out rail 9.

The ball bearings 5, 7 and 8 are seated upon aligned collars or collets 15 which are formed, such as by embossing or any other suitable working or machining step, at the oppositely situated parts 19 and 20, as best seen by referring to FIG. 4. Between the inner bore of the corresponding ball bearing, such as the inner bore 7*a* of the ball bearing 7 shown in FIG. 4 and the periphery of the related collar 15 there is formed a press fit. The rolls 1 and 6 can be mounted in similar fashion, wherein, however, a running fit is provided between the collars and bores of the rolls. According to the showing of FIG. 2 it is possible to also mount the rolls by means of the pins 1' at the pull-out rails 9 so as to be elevationally displaceable or shiftable within vertical elongate holes 25 of the collars 32.

The mounting of the ball bearings 5, 7 and 8 with a press fit at the collars 15 is particularly advantageous inasmuch as by virtue of this construction there is realized an additional support between the parts 19 and 20 of each of the pull-out rails 9.

With the modified embodiment of FIG. 3 the section or profile 18' of the stationary guide rail 2 is altered in the depicted manner in its shape relative to the profile or shape of the corresponding guide rail 2 of the arrangement of FIGS. 2 and 4. In particular, it will be seen that the leg region 118 neighboring the base of the W-shaped section or profile is more intensely inclined than with the embodiment of FIGS. 2 and 4.

While with the embodiment of FIGS. 2 and 4 each of the traveling rails 3 transforms by means of the flat inclined flank 103 into the actual axially parallel guide region containing the flat or planar guide surfaces at the top surface 4 and the bottom surface 4a of the corresponding traveling rail 3, with the modified arrangement of FIG. 3 there is provided a rounded flank or rail portion 104.

Figure 13:
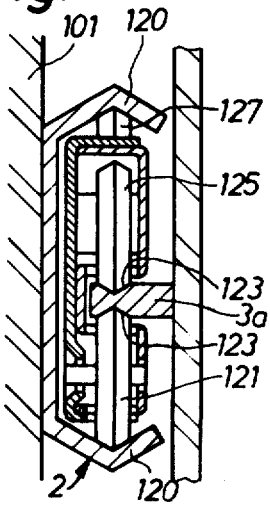
FIG. 13 is a variant sectional view, corresponding essentially to the showing of FIG. 2.

A further modification is shown in FIG. 13, wherein each such fixed or stationary guide rail 2 is provided with an obtuse-angle, substantially "V"-shaped or profiled leg 120. The running or traveling surfaces of the related ball bearings and rolls are correspondingly shaped, as generally indicated by reference characters 121, 125 and 127. In similar fashion there is profiled or shaped the guide tracks 123 at both sides or faces of the related traveling rail 3a. In this way there is realized a practically non-slipping guide with a pure rolling motion at all regions participating in the guiding action.

Figure 10:
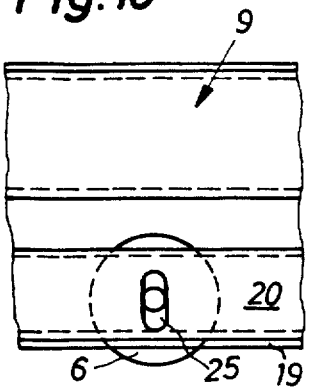
FIG. 10 is a detail of the arrangement of FIG. 1, taken substantially at the location X thereof.

FIG. 10 shows in greater detail, as previously mentioned and apparent from the showing of FIG. 2, the vertical mobility of the roll 6 in an elongate hole 25 of the appropriately configured collar or collet 32. By virtue of this vertical mobility the roll 6 can accommodate itself to all changes in the wall thickness S of the related traveling rail 3 at the region of travel thereof.

The foregoing description of the inventive differential roll or roller pull-out systems should make it eminently clear that with such depicted roll pull-out systems there can be realized by virtue of the guide construction which is provided at each rail of each rail pair a frictionally low, i.e, essentially lateral guiding action working with rolling friction, and at the same time there is obtained an extremely simple mounting of the roll bodies and equivalent structrue by virtue of the collars or collets which are formed at the pull-out rails.

While there are shown and described present preferred embodiments of the invention, it is to be distinctly understood that the invention is not limited thereto, but may be otherwise variously embodied and practiced within the scope of the following claims. Accordingly,

What is claimed is:

1. A differential roll pull-out system for a drawer or the like, comprising:
   - stationarily mounted guide rails;
   - pull-out rails guided at said stationarily mounted guide rails;
   - traveling rails guided at said pull-out rails;
   - said traveling rails coacting in pairs with the drawer;
   - roller bodies for mutually guiding said rails at one another;
   - each pull-out rail being constructed as a hollow profile member having at least one hollow compartment for receiving said roller bodies;
   - each pull-out rail being provided with a number of oppositely situated collars at which there are fixedly mounted without the use of bolts and screws the roller bodies cooperating with said pull-out rail;
   - each said pull-out rail including at least two different cooperating profile members;
   - said coacting profile members include cooperating tab means and slot means latchingly interfitting with one another in order to releasably interconnect said two profile members with one another.

2. A differential roll pull-out system for a drawer or the like, comprising:
   - stationarily mounted guide rails;
   - pull-out rails guided at said stationarily mounted guide rails;
   - traveling rails guided at said pull-out rails;
   - said traveling rails coacting in pairs with the drawer;
   - roller bodies for mutually guiding said rails at one another;
   - each pull-out rail being constructed as a hollow profile member having at least one hollow compartment for receiving said roller bodies;
   - each pull-out rail being provided with a number of oppositely situated collars at which there are fixedly mounted without the use of bolts and screws the roller bodies cooperating with said pull-out rail;
   - at least predetermined ones of said roller bodies including bearing means;
   - each of said bearing menas having a central bore;
   - predetermined ones of said collars of said pull-out rail coacting with the central bore of the related bearing means and forming a press fit.

3. The roll pull-out system as defined in claim 2, wherein
   - said bearing means are ball bearings.

4. The roll pull-out system as defined in claim 2, wherein
   - each pull-out rail includes two releasable interconnected profile members and said oppositely situted collars are on different ones of said profile members, the said bearing means comprising a means for holding said two profile members together.

5. A differential roll pull-out system for a drawer or the like, comprising:
   - stationarily mounted guide rails;
   - pull-out rails guided at said stationarily mounted guide rails;
   - traveling rails guided at said pull-out rails;
   - said traveling rails coacting in pairs with the drawer;
   - roller bodies for mutually guiding said rails at one another;
   - each pull-out rail being constructed as a hollow profile member having at least one hollow compartment for receiving said roller bodies;
   - each pull-out rail being provided with a number of oppositely situated collars at which there are fixedly mounted without the use of bolts and screws the roller bodies cooperating with said pull-out rails;
   - stop means provided for the drawer; and
   - stop springs provided both for said traveling rails and for said pull-out rails cooperating with said stop means for limiting the stroke during the insertion of the drawer.

6. The roll pull-out system as defined in claim 5, wherein:
   - said stop means comprises web means.

* * * * *